US007595466B2

(12) United States Patent
Huber

(10) Patent No.: US 7,595,466 B2
(45) Date of Patent: Sep. 29, 2009

(54) HOUSEHOLD APPLIANCE COMPRISING AN OPERATING STRIP

(75) Inventor: Johann Huber, Inzell (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 322 days.

(21) Appl. No.: 10/577,825

(22) PCT Filed: Oct. 25, 2004

(86) PCT No.: PCT/EP2004/052654

§ 371 (c)(1),
(2), (4) Date: Jun. 8, 2006

(87) PCT Pub. No.: WO2005/043043

PCT Pub. Date: May 12, 2005

(65) Prior Publication Data

US 2007/0084854 A1 Apr. 19, 2007

(30) Foreign Application Priority Data

Oct. 30, 2003 (DE) ..... 103 50 587

(51) Int. Cl.
*H05B 3/68* (2006.01)

(52) U.S. Cl. ..... 219/452.11; 219/460.1

(58) Field of Classification Search ... 219/443.1–468.2; 126/211, 217, 218, 39 H
See application file for complete search history.

(56) References Cited

U.S. PATENT DOCUMENTS

| | | | | |
|---|---|---|---|---|
| 4,453,533 | A * | 6/1984 | Scheidler et al. | 126/211 |
| 5,549,100 | A | 8/1996 | Heisner et al. | |
| 5,844,206 | A * | 12/1998 | Steiner et al. | 219/452.12 |
| 6,236,024 | B1 | 5/2001 | Gotz et al. | |
| 6,455,819 | B1 | 9/2002 | Pohl et al. | |
| 6,492,623 | B1 | 12/2002 | Vilato et al. | |
| 2002/0014482 | A1 | 2/2002 | Becker et al. | |
| 2005/0194373 | A1 | 9/2005 | Wilsdorf | |

FOREIGN PATENT DOCUMENTS

| | | |
|---|---|---|
| DE | 32 29 406 A1 | 3/1984 |
| DE | 82 31 895.6 | 5/1985 |
| DE | 298 21 862 U1 | 4/1999 |
| DE | 198 11 372 A1 | 9/1999 |
| DE | 198 17 195 C1 | 9/1999 |
| DE | 102 40 147 A1 | 3/2004 |
| GB | 2 125 537 A | 3/1984 |
| WO | WO 00/17579 | 3/2000 |

* cited by examiner

*Primary Examiner*—Sang Y Paik
(74) *Attorney, Agent, or Firm*—Laurence A. Greenberg; Werner H. Stemer; Ralph E. Locher

(57) ABSTRACT

Known household appliances for integrating into a sector of a worktop include an operating strip containing at least one operating element and having a supporting surface on the lower side thereof for supporting the household appliance on the worktop, and a housing part provided with a fixing flange to which the operating strip is fixed. The invention aims to produce the operating strip in a simple manner with high dimensional accuracy. To this end, the operating strip is produced primarily by forming or milling.

20 Claims, 6 Drawing Sheets

HOUSEHOLD APPLIANCE COMPRISING AN OPERATING STRIP

BACKGROUND OF THE INVENTION

Field of the Invention

The invention relates to a household appliance for integrating into a sector of a worktop comprising an operating strip containing at least one operating element and having a supporting surface on the lower side thereof for supporting the household appliance on the worktop.

Known from DE 198 11 372 C2 is a cooking surface with a light-permeable cooking hob made of glass ceramic and with control and display elements. The cooking surface has an operating strip with an operating surface facing an operator and a piezo sensor located below said operating surface which detects any touching of the operating surface and delivers a corresponding signal to the control unit. The operating strip is part of a stainless steel cooking surface frame which encloses the glass ceramic hob in a frame fashion and supports said hob. The cooking surface frame is supported with its bent edge on the top of a worktop on the circumferential side. Between the underside of the cooking surface frame and the worktop a seal surrounds the cooking surface section of the worktop.

SUMMARY OF THE INVENTION

It is the object of the invention to provide a household appliance for integrating into a section of a worktop whose operating strip is supported on the worktop and is manufactured simply and with high dimensional accuracy.

The object is solved according to the invention by a household appliance having the features of claim 1. According to the characterising part of claim 1, the operating element is essentially produced by forming or milling. Production by forming or milling reduces the risk of the operating strip distorting. The supporting surface of the operating strip can thus simply be constructed as flat, thus ensuring that the supporting surfaces rests flat on the worktop. This type of flat support of the operating element on the worktop is crucial when using piezo elements as operating elements. They can be arranged on an underside of the operating strip and detect an actuating pressure which is exerted on the upper side of the operating strip by a user. The actuating pressure exerted on the operating strip by the user is thus reliably detected by the piezo sensor and is not used to press the operating strip in contact with the worktop.

Forming is understood as the manufacture of a shaped part from a shapeless starting material (e.g. granules, melt, powder). For this purpose, the shapeless starting material is inserted (e.g. cast or pressed) in a special forming tool in which it is converted to the solid state by solidification or sintering. The shaped part formed in this way is removed from the forming tool. As a result of the manufacturing process, the operating strip largely acquires the necessary shape with high dimensional accuracy, reducing the number of after-treatment steps. Such high dimensional accuracy is particularly advantageous when using piezo sensors. By forming or milling, it is possible to implement technically advantageous profile shapes on the operating strip which are not possible with operating strips manufactured by continuous casting or are only possible with very great effort.

With regard to the stability it is favourable if the material thickness of the operating strip changes depending on the respective requirements. A very high thermal stability of the operating strip is thus obtained. At the same time, the risk of the operating strip warping is reduced. Likewise, further elements for assembly of the operating strip and its mounting in one piece can be constructed on the operating strip, whereby the effort required for assembly is further reduced. The aforesaid advantages can also be achieved by an operating strip which is substantially fabricated by milling.

The operating strip can preferably have a plurality of recesses separated from one another on its underside wherein various appliance components are arranged. In this case, the operating strip can be made of a solid semi-finished product having high dimensional stability. Only the recesses required for the appliance components are incorporated in the semi-finished product. As a result, on the one hand, the operating strip can be produced inexpensively. At the same time its stability is enhanced and its design is appealing.

It is advantageous if at least one mounting recess is constructed on the underside of the operating strip, wherein a housing-side fixing flange is in abutment with the operating strip. The mounting recess simplifies correct positioning of the operating strip with respect to the housing of the household appliance when assembling the household appliance.

In a particular exemplary embodiment, the housing-side fixing flange is arranged in the mounting recess of the operating strip such that it is staggered in relation to its supporting surface or ends flush with the supporting surface in a sealed manner. The fixing flange is thus recessed in the mounting recess. The overall height of the operating strip is thus not increased by the fixing flange.

For a compact and rigid design it is preferable if the mounting recess is substantially surrounded by the supporting surface of the operating strip. In this case, the mounting recess of the operating strip can be arranged outside the worktop section on the upper side of the worktop.

It is advantageous for assembly if one edge of the mounting recess substantially positively defines the housing-side fixing flange. The correct positioning of the housing-side fixing flange with the operating strip can thereby be further simplified.

In order that the operating strip is held rigidly on the housing of the household appliance, a plug-in recess can be formed on the underside of the operating strip. A corresponding plug-in portion formed on the housing side can be inserted therein during assembly. This plug-in portion serves as a counter-bearing which can receive forces, for example, a torque. The plug-in recess can preferably be constructed inside the mounting recess of the operating strip. In this case, the plug-in portion can be constructed simply from the production engineering point of view directly on the fixing flange, whereby a compact design is achieved. In order to achieve a positive connection between the plug-in portion on the housing side and the plug-in recess of the operating strip, a plastic adapter can be inserted, ensuring a positive connection between the plug-in portion and the operating strip.

For fixing the operating strip on the housing of the household appliance, the housing-side fixing flange can be connected to the mounting recess of the operating strip.

An exemplary embodiment of the invention is explained hereinafter with reference to the appended figures. In the figures:

DESCRIPTION OF THE PREFERRED EMBODIMENTS

Figure 1:
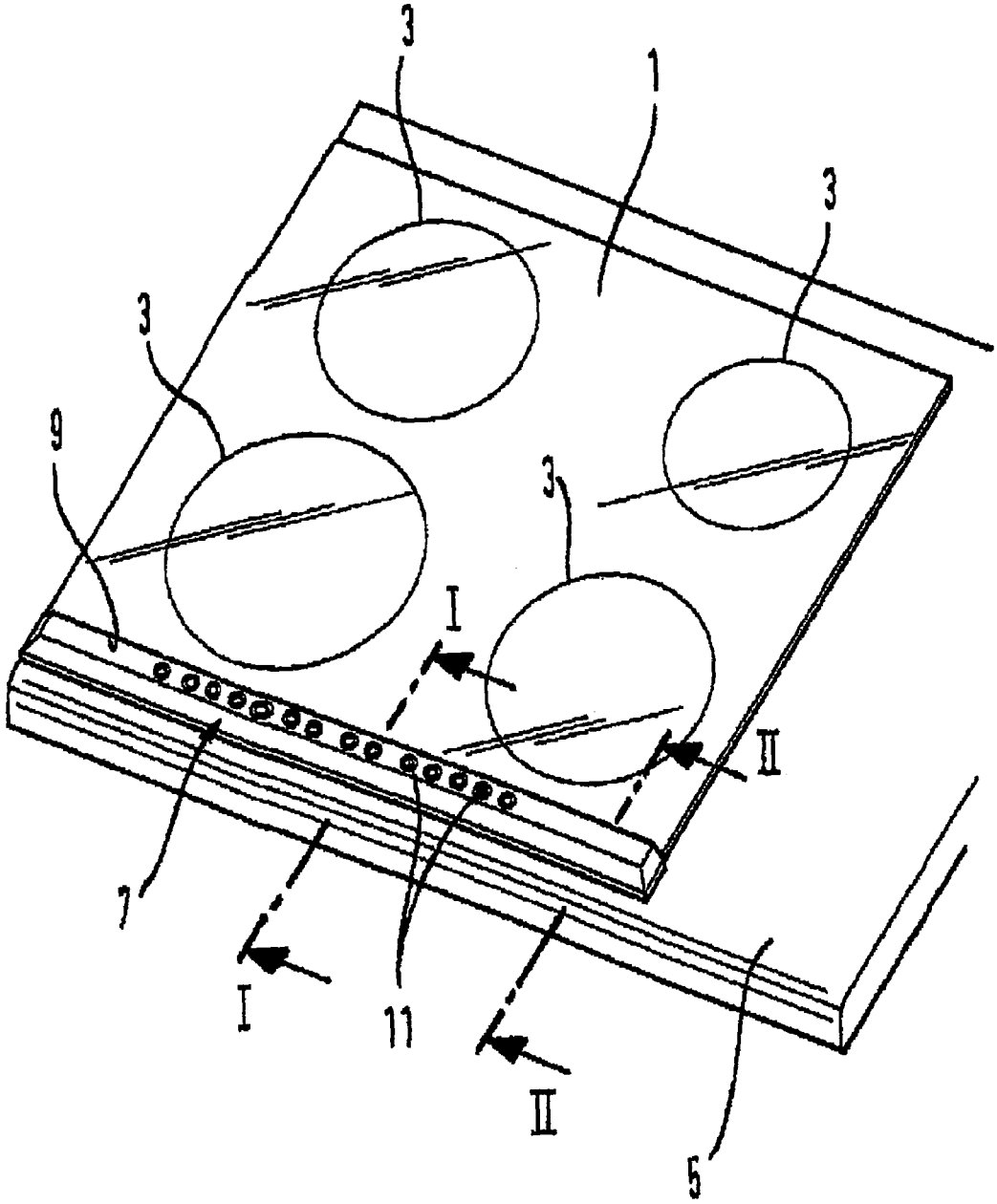
FIG. 1 is a perspective view of a cooking surface inserted in a worktop.

FIG. 1 shows a cooking surface as a household appliance comprising a glass ceramic plate 1 with four different cooking zones. Suitable heating elements are arranged in a fashion known per se underneath a decorative printing 3 of the cooking zones. The cooking surface is inserted in a section of a worktop 5 and is supported on an upper side of the worktop 5. At its front side facing an operator, the cooking surface is supported on the worktop 5 by means of a control strip 7. On its other sides the cooking surface is supported on the worktop 5 by means of a circumferential edge of the glass ceramic plate 1. The operating strip 7 consists of aluminium and has circular protuberances 11 for actuating the cooking surfaces on its upper side 9. The operating strip 7 can also be part of a closed cooking surface frame which surrounds the glass ceramic plate 1 in a frame fashion.

Figure 2:
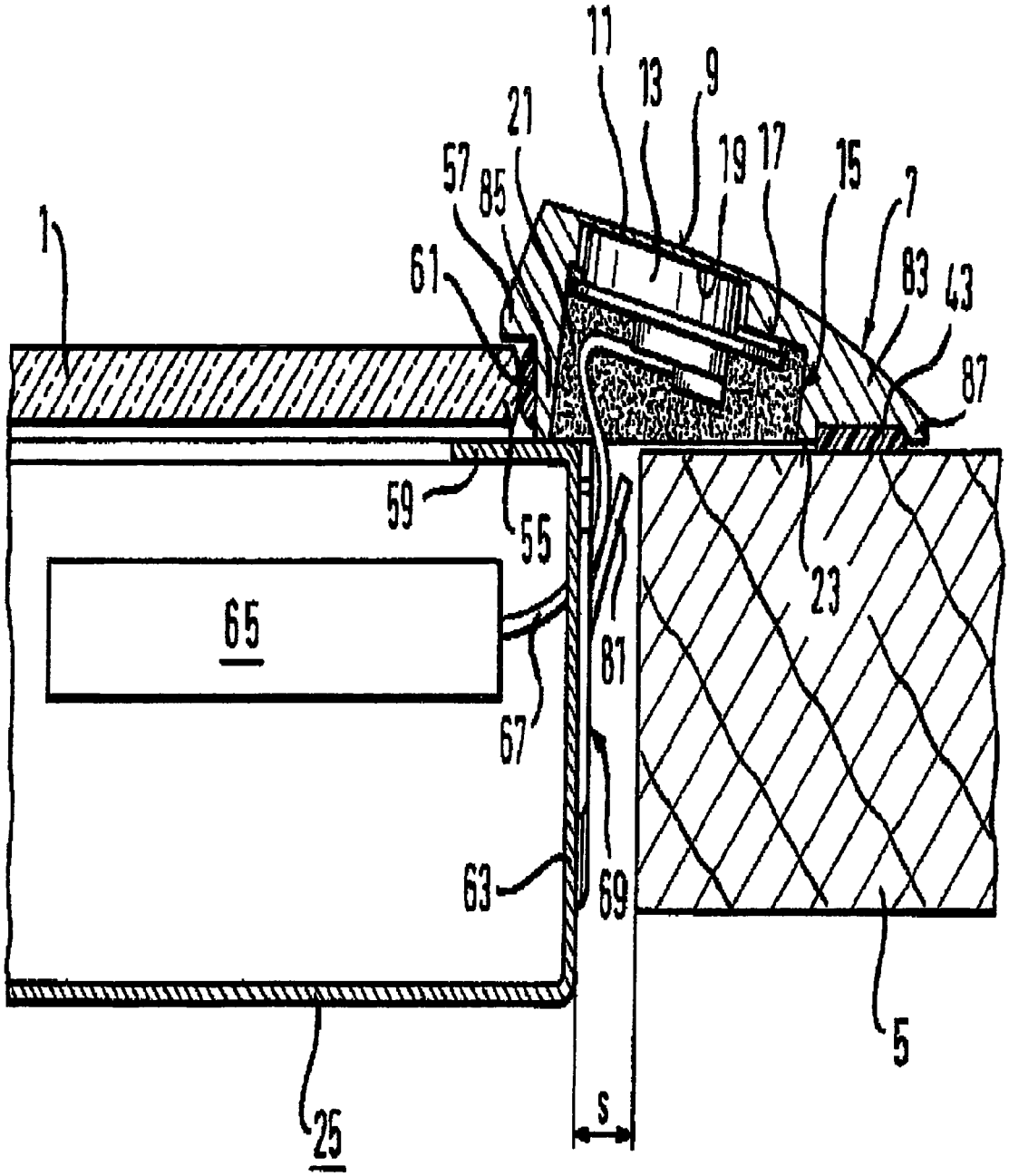
FIG. 2 is a side sectional view of part of the cooking surface along the line I-I from FIG. 1.

The operating strip 7 is constructed as having a wedge-shaped cross-section according to FIG. 2. The upper side 9 of the operating strip 7 is slightly curved and inclined towards the worktop 5. This ensures a smooth transition between the worktop 5 and the operating strip 7 which is advantageous both visually and for cleaning.

The cooking surfaces are operated by pressing with the finger on the corresponding protuberance 11 according to FIG. 1. This finger pressure is received by a piezo sensor 13 located on an underside of the operating strip directly below the protuberance 11, which converts the finger pressure into an electronic signal. According to FIG. 2, the piezo sensor 13 is arranged in a recess 15 constructed on the underside of the operating strip 7. A positioning recess 19 for the piezo sensor 13 is incorporated in a bottom 17 of the recess 15 which simplifies the positioning of the piezo sensor 13 in the correct position inside the recess 15. In addition, the wall thickness between the positioning recess 18 and the opposite protuberance 11 is substantially reduced on the upper side to enhance the response sensitivity of the piezo sensor 13. The piezo sensor is firmly cast in the recess 15 using a plastic casting compound 21.

Likewise a supporting surface 23 is constructed on the underside of the operating strip 7 by which means the cooking surface is supported on the upper side of the work top 5. The piezo sensor 13 is arranged in such as way that it is staggered with respect to the supporting surface 23 in the recess 15 of the operating strip 7. As a result, the operating strip 7 can also be supported in the area of the recess 15 on the worktop 5 without damaging the piezo sensor 13. According to FIG. 2, the operating strip 7 lies mostly on the upper side of the worktop 1. When pressure is exerted on the protuberance 11, the worktop 1 thus acts as a stable counter-bearing for the operating strip, ensuring that pressure is reliably absorbed by the piezo sensor 13.

Figure 3:
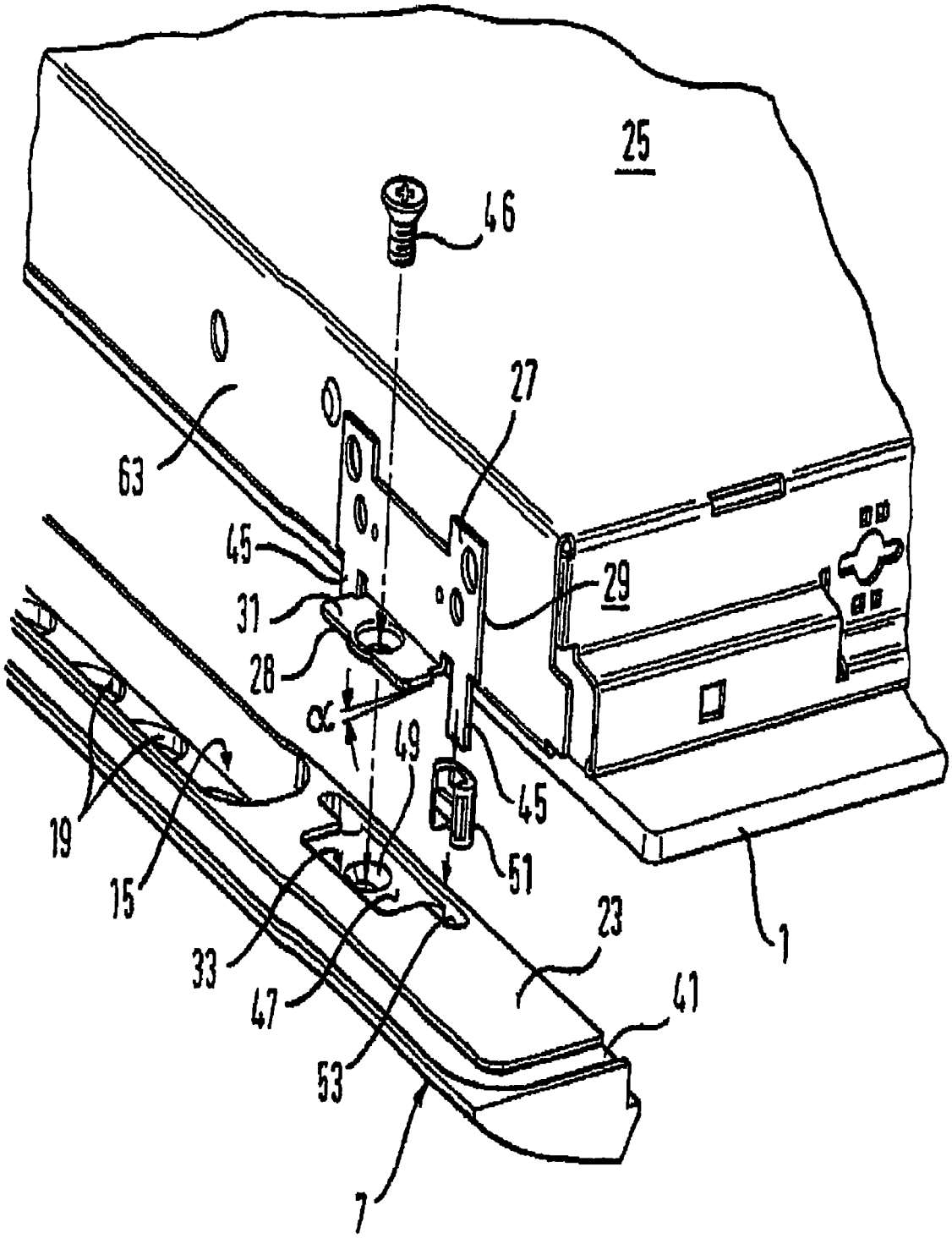
FIG. 3 is an exploded view of a section of the cooking surface.

Two angular portions 29 spaced apart from one another are welded on an outer side of the housing 25 by means of their first leg 27 to fix the operating strip 7 on a housing 25 of the cooking surface. The housing 25 can consist of one piece or of several separate portions, possibly a housing frame with a bottom cover. The angular portions consist of a steel sheet; one of the angular portions 29 is shown in FIG. 3. A second leg 28 bent thereto is bent almost parallel to the glass ceramic plate 1 and has a fixing flange 31. The fixing flange 31 is inserted in the assembled state of the cooking surface in a mounting recess 33 on the underside of the operating strip 7.

The second leg 28 is not bent at right angles but at a slightly smaller angle than 90° to the first leg 27. As a result, in the assembled state the operating strip 7 with its supporting surface 23 is bent downwards at an angle of inclination a of about 0.5° with respect to the cooking surface shown in FIG. 3. The angular portion 29 has sufficient elasticity. This ensures that even in the case of unevenness on the upper side of the worktop, the operating strip 7 reliably rests on the worktop over its entire length.

The mounting recess 33 is surrounded by the supporting surface 23. As shown in FIG. 3, a sealing channel 41 is further formed on the underside of the operating strip 7. A sealing strip 43 shown in FIG. 4 which extends on the circumferential side over the entire cooking surface is glued in the sealing channel 41. Both the mounting recess 33 and also the recess 15 for the piezo sensors 13 are arranged inside the sealing strip 43. The fixing flange 31 is arranged so that it is recessed in the mounting recess 33 of the operating strip 7. The overall height of the operating strip 7 supported on the worktop 5 is thereby reduced. Inserting the fixing flange 31 into the mounting recesses 33 simply ensures that the operating strip 7 is correctly positioned with respect to the housing 25. For this purpose one edge of the mounting recess 33 substantially positively defines the housing-side fixing flange 31. According to FIG. 4, the fixing flange 31 is arranged between the operating strip 7 and the upper side of the work top.

In addition to the fixing flange 31, two plug-in portions 45 are constructed on the second leg 28, these being arranged in one plane with the first leg 27 welded on the housing 25 and thus oriented perpendicular to the glass ceramic plate 1. The fixing flange 31 is arranged between the two plug-in portions 45. In the assembled state of the cooking surface the fixing flange 31 is in flat abutment with a mating surface 47 constructed in the mounting recess 33. The fixing flange 31 can be screwed into a threaded hole 49 by means of a countersunk head screw which is constructed in the mating surface 47. The plug-in portions 45 additionally have a plastic adapter 51 by which means the plug-in portions are inserted positively in a corresponding plug-in recess 53 constructed inside the mounting recess 33. In this way, the plug-in portions 45 constructed perpendicular to the fixing flanges 31 form a counter-bearing which ensures that the operating strip 7 is held rigidly on the housing 25. At the same time, the plug-in portions 45 centre the operating strip during mounting of the operating strip 7 on the housing 25.

Figure 4:
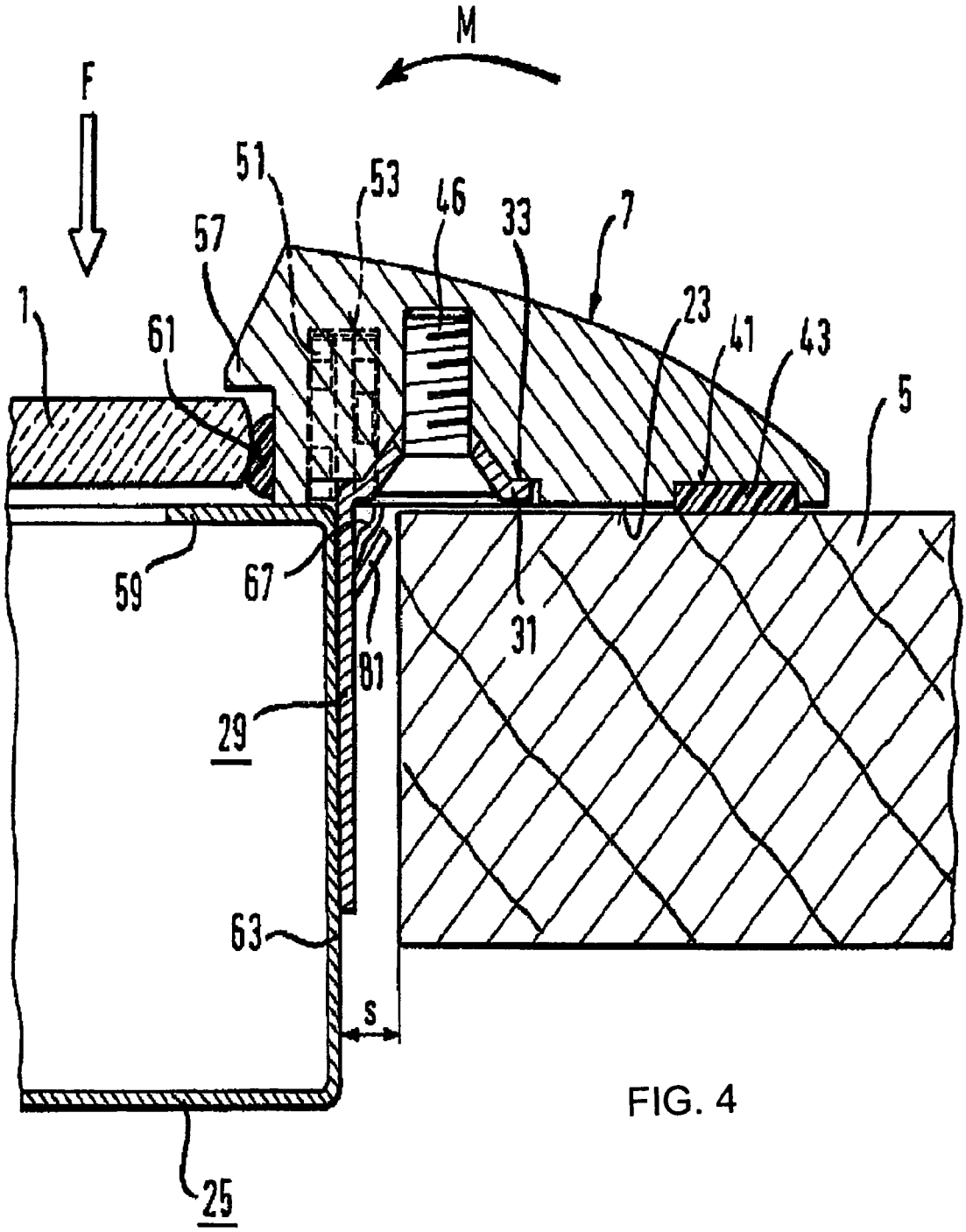
FIG. 4 is a side sectional view of part of the cooking surface along the line II-II from FIG. 1.

If, as shown in FIG. 4, food containers exert a force on the cooking surface in a direction of the arrow F, a torque acts on the fixing flange 31 in the direction of the arrow M. This torque is substantially absorbed by the plug-in portions 45 of the angular sections 25. The operating strip 7 is thus held particularly dimensionally stably and rigidly on the housing 25. According to the invention, the supporting surface 23 of the operating strip 7 is only spaced by a narrow mounting gap s of 5 mm for example from the cooking surface housing 25. Thus, the lever arm length allocated to the torque M is accordingly reduced.

A side edge 55 of the glass ceramic plate 1 is disposed between an overhang 57 of the operating strip 7 facing the glass ceramic plate 1 and a supporting flange 59 of the housing 25. A seal 61 is arranged between the side edge 55 of the glass ceramic plate 1 and the operating strip 7.

The cooking surface housing 25 is constructed as trough-shaped with elevated side walls 63. At their upper end the side walls 63 have the supporting flange 59 which is bent inwards at right angles. The supporting flange 59 of the side walls 63 is glued to an underside of the glass ceramic plate 1 using a silicone adhesive not shown. With the exception of the front side, the glass ceramic plate 1 is supported at its side edge 55 on the upper side of the worktop 5. Located between the glass ceramic plate 1 and the worktop 5 is the sealing strip 43 disposed on the circumferential side which is guided in the area of the front operating strip 7 in the sealing channel 41.

Figure 5:
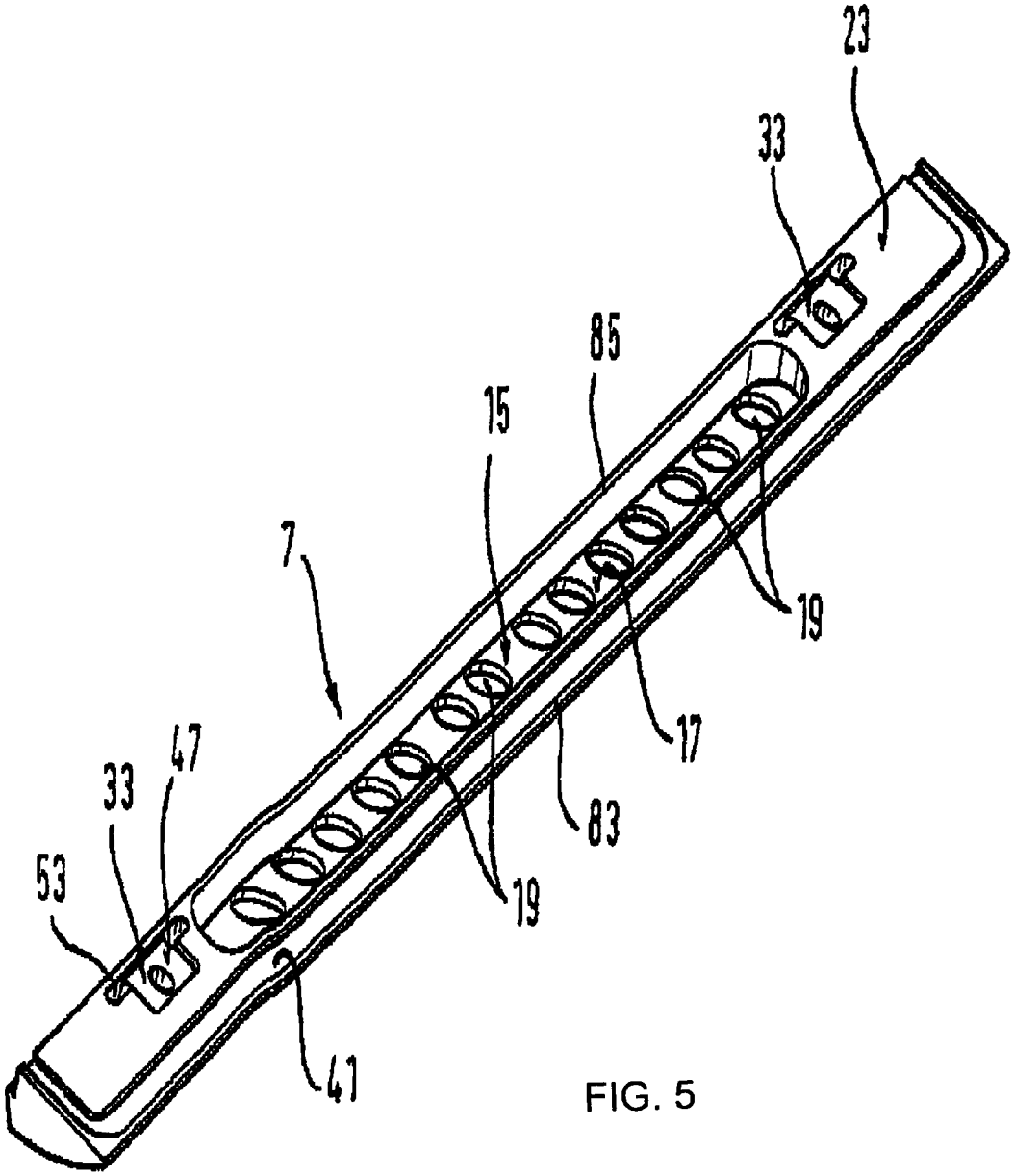
FIG. 5 is an operating strip of the cooking surface.

FIG. 5 shows the underside of the operating strip 7 without the cooking surface housing 25 and without piezo sensors 13. The operating strip 7 is made of an extruded profile of aluminium for example. In a further production step the mounting recesses 33 with the recess 15 for the piezo sensors 13 located therebetween are formed in the extruded profile by milling. Treatment of the operating strip 7 by milling allows a high dimensional accuracy whereby the number of after-treatment steps is reduced. Furthermore, the material thickness of the operating strip 7 can be modified with high dimensional accuracy and adapted to the respective requirements. For this reason the risk of the operating strip becoming distorted is reduced substantially.

The electrical signal produced by the piezo sensors 13 are guided via connecting leads 67 to an electronic control device 65 provided inside the housing 25. FIG. 2 shows one of the connecting leads 67. The connecting leads 67 are combined to form a cable strand and guided from the casting compound 21 cast in the recess 15. The ends of the connecting leads 67 are connected to a plug 68 shown in FIG. 6. This is guided through a housing opening provided in the housing side wall as far as the electronic control device 65 and connected thereto.

Figure 6:
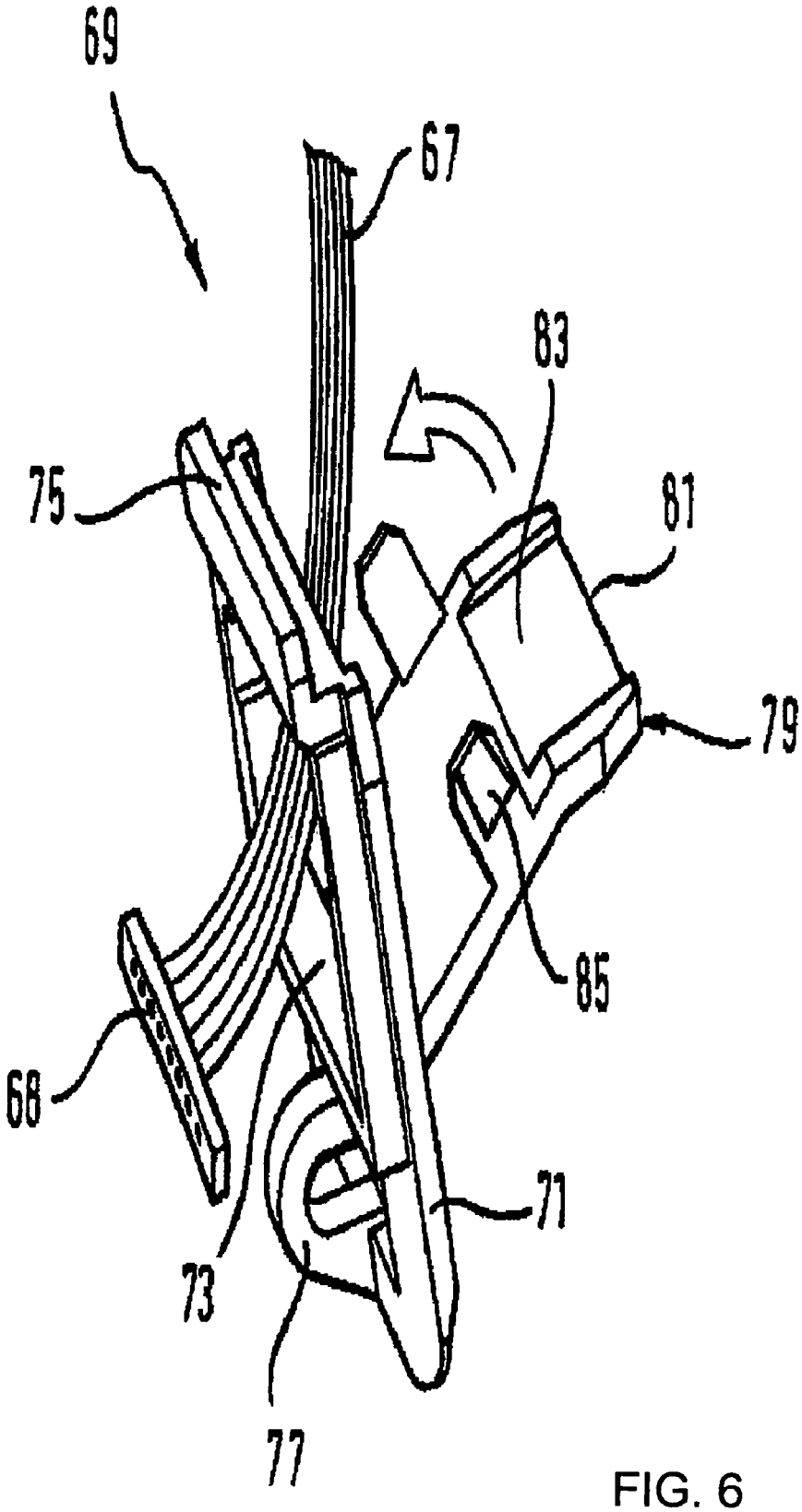
FIG. 6 is a guide element to be inserted in a housing opening of the cooking surface.

Located in the housing opening is a feed-through element 69 shown in detail in FIG. 6. The feed-through element 69 is manufactured as a plastic injection moulding having a frame 71 which is inserted in the housing opening. The frame 71 defines a feed-through opening 73 through which the connecting leads 67 protected from the sheet-metal edges of the housing opening are guided to the control device 65. Constructed on an upper strip of the frame 71 is a bearing flange 75 which, when inserted, is in abutment on the inside with the edge of the housing opening. Formed centrally on a lower strip of the frame 71 is a locating lug 77 which locates in the side wall of the housing 25 for fixing the feed-through element 69. Likewise, a flap-like adjusting member 79 is pivotally connected by means of a film hinge to the lower strip of the frame 71. Depending on its pivoting position, the adjusting member 79 can change the cross-section of the feed-through opening 73.

When inserting the feed-through element 69, its bearing flange 75 is first guided from outside through the housing opening of the housing and brought into abutment with the edge zone of the housing opening on the inside. The locating lug 77 is then pressed into a corresponding locating section of the side wall of the housing.

FIG. 6 shows the flap-like adjusting member 79 in the opened position so that the cross-section of the feed-through opening 73 is correspondingly enlarged. As a result, the plug 68 can be simply guided through the feed-through opening 73 as far as the control device 65. The adjusting member 79 is constructed as substantially plate-like and has an offset projection 81 constructed with a groove-like recess 83. Located on the opposite side edges of the adjusting member 79 are locating elements 85 which engage detachably behind the lateral strips of the feed-through frame 71 when the adjusting member 79 is closed. In this position of the adjusting member 79 the cross-section of the feed-through opening is reduced to a small gap formed between the groove-like recess 83 of the adjusting-member projection 81 and the upper frame strip. In this case, the connecting leads 67 are sufficiently fixed by the assembly technique. At the same time, when the adjusting member 79 is closed, access to the connecting leads 67 is made substantially more difficult by the offset projection 81 of the adjusting member since the section of the connecting leads 67 running on the outside of the housing is almost completely shielded by the offset projection 81 of the adjusting member (see FIG. 2). The offset projection 81 of the adjusting member 79 also acts as a spacer which maintains a narrow mounting gap s between the housing 25 and the cut-out edge of the worktop 5 after inserting the cooking surface into the section of the worktop 5 according to FIG. 4, without the connecting leads 67 being damaged during insertion into the cooking surface.

According to FIG. 5, the recess 15 for the piezo sensors 13 is constructed as a groove shape between the two longitudinal front faces of the operating strip. To enhance the torsional stability of the operating strip 7, its recess 15 is surrounded by solid material sections. At the same time, the dimensional stability of the operating strip is enhanced by a front stabilising wall 84 and a rear stabilising wall 85 between which the recess 15 is located. Adjacent to the front stabilising wall 83 of the operating strip 7 is a material section 87 having a wedge-shaped cross-section whereby the dimensional stability is further increased in the front area of the operating strip 7.

Pivot pins not shown are constructed on one side wall of the housing 25. When the cooking surface is inserted in the section of the worktop, these pivot pins engage in spring elements of mounting strips disposed at the edge of the worktop section. As long as the pivot pins are engaged in the spring elements of the mounting strips, the spring elements of the mounting strips press the cooking surface over the operating strip 7 and the circumferential edge of the glass ceramic plate 1 against the upper side of the worktop 5.

I claim:

1. A household appliance for integrating into a section of a worktop, comprising:

a formed or milled operating strip containing at least one operating element;

said operating strip including a supporting surface on a lower side thereof for supporting the household appliance on the worktop at a first side of the household appliance;

the appliance having a circumferential edge around only the remaining sides of the household appliance and not the first side, said circumferential edge for supporting the remaining sides of the household appliance on the worktop.

2. The household appliance according to claim 1, wherein said operating strip has a material thickness that changes in dependence on given requirements.

3. The household appliance according to claim 1, wherein said operating strip consists of a semi-finished product made of solid material.

4. The household appliance according to claim 1, wherein said operating strip is formed with at least one recess for an appliance component.

5. The household appliance according to claim 4, wherein said recess together with said supporting surface is constructed on an underside of said operating strip.

6. The household appliance according to claim 4, wherein said operating strip is formed with at least one mounting recess wherein a housing-side fixing flange of a housing portion is in abutment with said operating strip.

7. The household appliance according to claim 6, wherein said housing-side fixing flange engages in said at least one mounting recess of the operating strip offset backwardly relative to said supporting surface or flush with said supporting surface.

8. The household appliance according to claim 4, wherein said at least one recess is substantially surrounded by said supporting surface of said operating strip.

9. The household appliance according to claim 6, wherein said mounting recess has an edge surrounding said housing-side fixing flange substantially with a form lock.

10. The household appliance according to claim 6, wherein an inside of said mounting recess of said operating strip has a plug-in recess formed therein for inserting a corresponding plug-in portion on said housing portion.

11. The household appliance according to claim 10, which further comprises a plastic adapter disposed on said plug-in portion and configured for inserting said plug-in portion with a form lock in said plug-in recess of said operating strip.

12. The household appliance according to claim 6, wherein said housing-side fixing flange is connected to said operating strip by way of a screw connection.

13. The household appliance according to claim 6, wherein an inside of said mounting recess of said operating strip is formed with a mounting surface, and said fixing flange comes into detachable abutment with said mounting surface.

14. The household appliance according to claim 6, wherein said mounting recess is one of a plurality of mounting recesses spaced apart from one another are formed in the underside of said operating strip.

15. The household appliance according to claim 14, wherein at least one recess for said operating element is disposed between said mounting recesses.

16. The household appliance according to claim 15, wherein said mounting recess and/or said at least one recess for said operating element are arranged one after the other in a row.

17. The household appliance according to claim 1, wherein said operating strip is formed with a recess for receiving an operating element of the appliance and with one or more mounting recesses for receiving a housing-side fixing flange, and wherein said mounting recesses and said recess for said operating element are disposed in a row.

18. A household appliance for integration into a section of a worktop, comprising:

a housing portion including a housing-side fixing flange;

a formed or milled operating strip containing at least one operating element and having a supporting surface on a lower side thereof in contact with the worktop for supporting the household appliance on the worktop;

said operating strip including at least one recess for an appliance component and at least one mounting recess in said supporting surface; and said housing-side fixing flange of said housing portion abutting said operating strip.

19. The household appliance of claim 18, wherein said housing-side fixing flange is connected to said operating strip by way of a screw connection.

20. A household appliance for integration into a section of a worktop, comprising:

a housing portion including a housing-side fixing flange;

a formed or milled operating strip containing at least one operating element and having a supporting surface on a lower side thereof in contact with the worktop for supporting the household appliance on the worktop;

said operating strip including at least one recess in said supporting surface for an appliance component; and said at least one recess being substantially surrounded by said supporting surface of said operating strip.

* * * * *